US005515989A

United States Patent [19]

Petrie et al.

[11] Patent Number: 5,515,989

[45] Date of Patent: May 14, 1996

[54] TANK SHOE SPRING AND DOUBLE SEAL

[75] Inventors: Jack G. Petrie, Estes Park; John R. Mulkey, Westminster, both of Colo.

[73] Assignee: Tanco Engineering, Inc., Longmont, Colo.

[21] Appl. No.: 194,073

[22] Filed: Feb. 9, 1994

[51] Int. Cl.[6] ..... B65D 88/46; B65D 88/34

[52] U.S. Cl. ..... 220/224; 220/216

[58] Field of Search ..... 220/221, 222, 220/224, 216, 226

[56] References Cited

U.S. PATENT DOCUMENTS

| | | | |
|---|---|---|---|
| 2,855,122 | 10/1958 | Ulm et al. | 220/224 X |
| 2,884,156 | 4/1959 | Graham et al. | 220/224 |
| 3,119,511 | 1/1964 | Giannini | 220/226 |
| 4,130,216 | 12/1978 | Creith | 220/224 |
| 4,308,968 | 1/1982 | Thiltgen . | |
| 4,524,878 | 6/1985 | Imhof | 220/224 |
| 4,811,859 | 3/1989 | Kinghorn, Jr. | 220/224 |
| 5,036,995 | 8/1991 | Wagoner | 220/224 |
| 5,078,293 | 1/1992 | Lippiello . | |
| 5,103,992 | 4/1992 | Lippiello et al. . | |
| 5,284,269 | 2/1994 | Petrie et al. | 220/224 |
| 5,301,828 | 4/1994 | McKay | 220/221 |

*Primary Examiner*—Gary E. Elkins
*Assistant Examiner*—Nathan J. Newhouse
*Attorney, Agent, or Firm*—Rick Martin

[57] ABSTRACT

The space saving double seal uses a lower shoe, an upper shoe and a pair of vapor barriers joining them to a conventional outer rim plate on a floating roof. The secondary vapor barrier extends from the outer rim plate to the top of the upper shoe. A pair of pusher springs maintain the shoes against the tank's inner wall. The invention provides for liquid storage to the full height which the floating roof allows. Additionally an improved primary and/or secondary shoe leaf spring and pusher brace combination improves the seal between the shoe and the inner wall.

14 Claims, 16 Drawing Sheets

TANK SHOE SPRING AND DOUBLE SEAL

CROSS REFERENCE PATENTS

U.S. Pat. No. 5,284,269 (1994) to Petrie et at. is incorporated herein by reference.

FIELD OF INVENTION

The present invention relates to a tank shoe spring combination for a tank shoe in a floating roof of a liquid storage tank such as a gasoline storage tank, wherein the tank shoe spring arrangement maximizes the force against the shoe on the inside of the tank.

BACKGROUND OF THE INVENTION

Increasingly stringent pollution standards have resulted in the standard practice of using a double seal arrangement in the space between a floating roof and the inner walls of a fuel storage tank. There exist many types of double seal arrangements for floating roofs. U.S. Pat. No. 4,308,968 (1982) to Thiltgen et al. discloses a primary vapor barrier bolted between the floating roof and a shoe which rides on the wall of the tank. A secondary seal comprises a flexible support arrangement mounted on the floating roof. The flexible support has flexible wipers pushing against the inner wall of the tank. The secondary seal projects about 24 inches above the primary seal. The disadvantage of this arrangement is that the storage tank loses 24 inches of its storage capacity.

FIG. 1 shows another commonly used arrangement. A floating roof 1 floats atop the liquid 10. A shoe 5 slides along the inner wall 4 of tank 2. The shoe 5 is pushed against the inner wall 4 by a pusher spring 6 which is mounted against the outer rim plate 7. Brace 8 helps support the shoe support 9. The shoe support 9 also pushes shoe 5 against inner wall 4. The volatile liquid 10 evaporates vapors 11 which are trapped by a primary seal comprising a shoe 5 and a primary vapor barrier 12. Primary vapors 11 create a saturated vapor space. Primary vapor barrier 12 is mounted between shoe 5 and outer rim plate 7. A compression plate 14 supports a secondary seal 13 against the inner wall 4. This arrangement satisfactorily seals in the secondary vapors 110.

However, the compression plate 14 rises a height h2 above the primary vapor barrier 12. The height from the liquid surface 16 to the tank top 15 is h1. The height h2 is lost for liquid storage purposes.

The present invention eliminates the lost storage height h2 while providing the same double seal protection shown in FIG. 1. It would not be effective to merely put a secondary vapor barrier parallel to the primary vapor barrier 12 and mounted to the shoe 5 and outer rim plate 7. Due to the irregular shape of the inner wall 4 there is often a vapor leak between shoe 5 and inner wall 4. Therefore, merely stringing another vapor barrier from shoe 5 to outer rim plate 7 would not capture any fumes from a vapor leak between inner wall 4 and shoe 5.

One embodiment of the present invention utilizes a double shoe arrangement with a primary and secondary vapor barrier extending to the outer rim plate.

The General American Transportation Company circa Sep. 20, 1956 manufactured a primary shoe assembly having a single horizontal leaf spring support. The single horizontal leaf spring support extended outwardly directly from the outer rim plate. However, no teaching of a pusher brace or a vertical pusher spring was disclosed.

U.S. Pat. No. 5,103,992 (1992) to Lippiello et al. discloses a primary shoe on a floating roof. The outer rim plate supports the shoe by a combination of scissors hanger assemblies, a leaf spring, and a pusher plate. No pusher brace nor vertical pusher spring is disclosed.

U.S. Pat. No. 5,078,293 (1992) to Lippiello discloses a primary shoe having a flotation chamber and a lever bracket affixed to the outer rim plate. The flotation chamber forces the lever bracket against the primary shoe, thereby urging it against the inside of the tank. No pusher brace is taught. The lever bracket functions like a vertical pusher spring.

An improvement over the pusher spring 6 of FIG. 1 and the above noted prior art is disclosed herein. The preferred embodiment of the spring means for supporting the lower (primary) shoe against the inner wall of the tank is a combination of a pusher brace depending from the floating roof, a vertical pusher spring extending upward and outward from the bottom of the pusher brace, and two horizontal leaf springs. The first leaf spring extends in a V shape from the top of the pusher brace to the primary shoe. The second leaf spring extends in a V shape from the bottom of the pusher brace to the primary shoe. This spring combination provides spring pressure points against the top of the primary shoe first by a leaf spring member, next by the vertical pusher brace, and third by the second leaf spring member. This new spring combination can be used to improve the Thiltgen et al. patent noted above as well as U.S. Pat. No. 5,284,269 (1994) to Petrie et al., which is incorporated herein by reference.

SUMMARY OF THE INVENTION

The primary object of the present invention is to support a primary shoe of a floating roof with a vertical pusher brace and a pair of horizontal leaf springs, thereby maintaining a tight seal of the primary shoe against the inside of the tank.

Another object of the present invention is to provide a double shoe seal floating roof closure to the inner wall of a tank wherein there is a minimal loss of storage height caused by the double shoe seal.

Other objects of this invention will appear from the following description and appended claims, referenced being had to the accompanying drawings forming a part of this specification wherein like reference characters designate corresponding parts in the several views.

The present invention centers on a downward facing pusher brace depending from a conventional outer rim plate. This pusher brace supports a vertical shoe support pusher spring for a lower primary shoe. The pusher brace exerts force on the primary shoe by an upper V shaped leaf spring. The top of the upper leaf spring pushes against the shoe in between the V of the leaf spring. A lower V shaped leaf spring pushes against the lower portion of the shoe. An optional second shoe is slidingly engaged in a conventional manner with the inner wall of a tank. Any vapor leaks of the first shoe are caught by the second shoe above it. Vapor barriers are mounted between the top of each shoe and the outer rim plate.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 2:
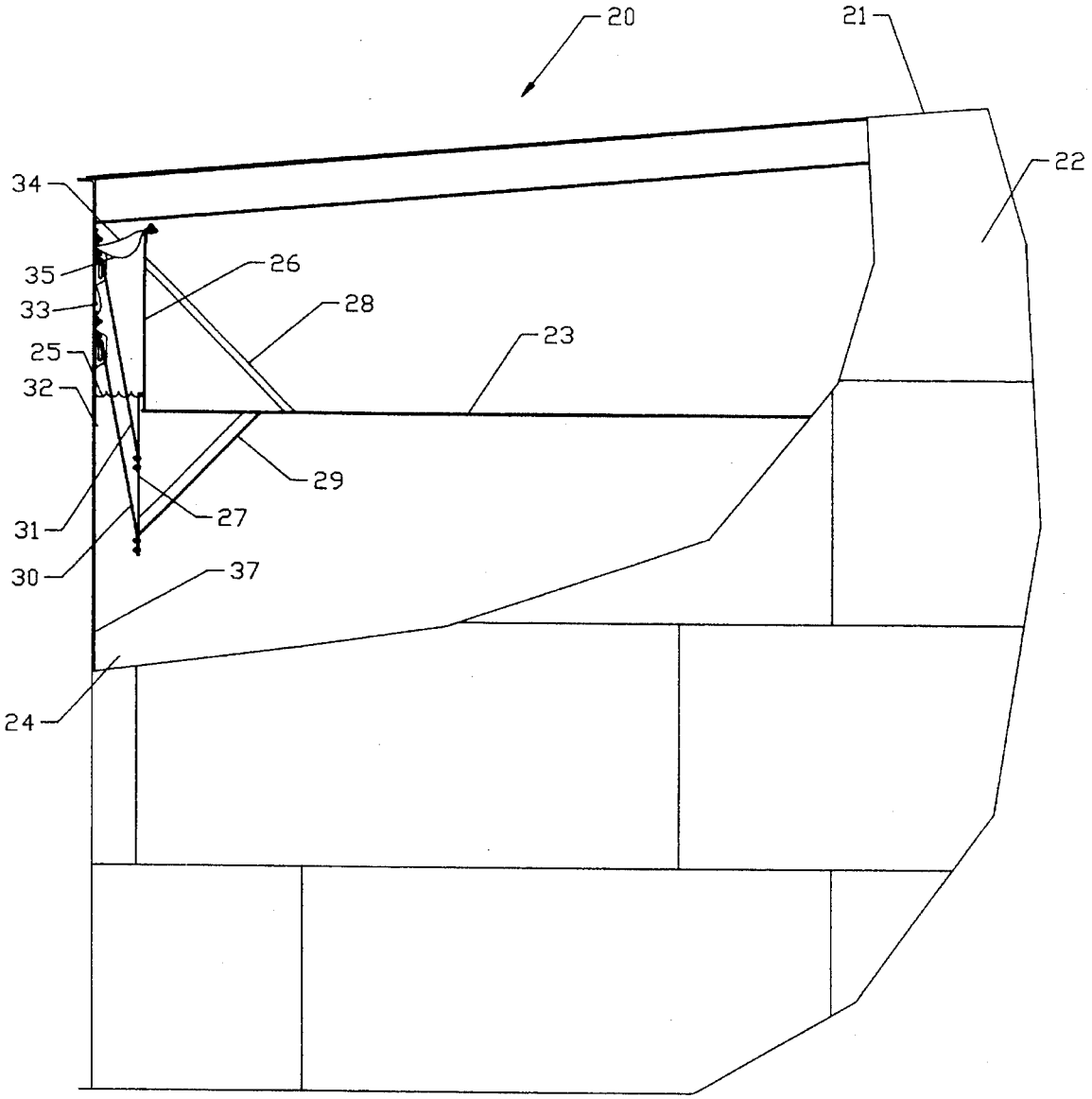
FIG. 2 is a front plan view of a storage tank with a partial cutaway showing the floating roof and the space saving double seal.

Referring first to FIG. 2 a tank 20 has a cylindrical outer wall 22, an inner wall 37 and a fixed roof 21. The stored liquid 24 has a top surface 25. A floating roof 23 has an outer rim plate 26. A downward extending pusher brace 27 is supported by brace 29.

Figure 1:
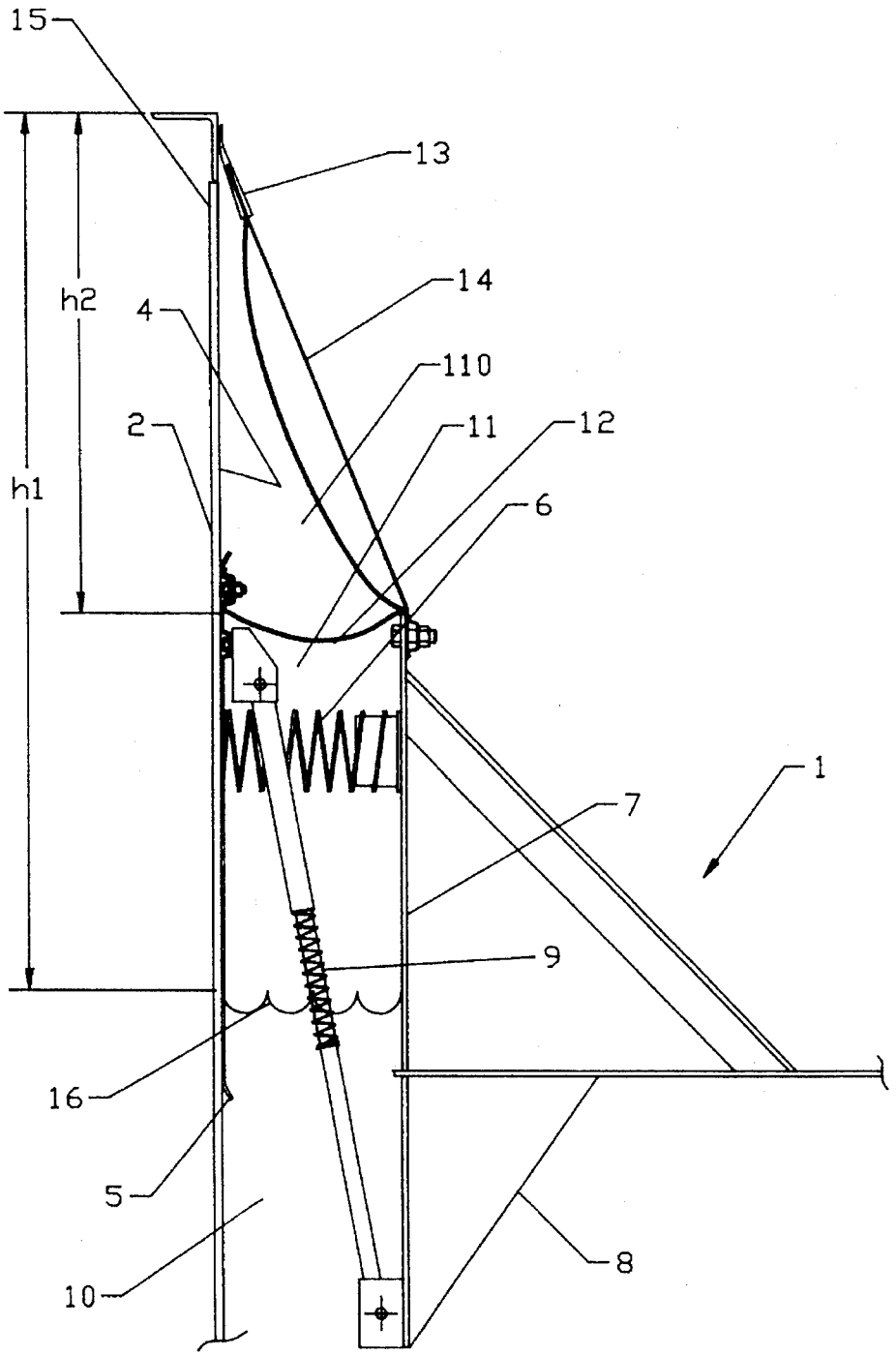
FIG. 1 (PRIOR ART)
FIG. 1 (Prior Art) is a cross sectional view of a conventional dual seal assembly for a floating roof.

Lower shoe 32 is pushed against inner wall 37 by pusher spring 30. Upper shoe 33 is pushed against inner wall 37 by pusher spring 31. A primary seal assembly comprises the members lower shoe 32, and primary vapor barrier 35. Vapor barrier 35 extends from outer rim plate 26, in front of upper shoe 33 and finally attaches to the top of lower shoe 32. A secondary seal assembly comprises the members upper shoe 33 and vapor barrier 34 which extends between upper shoe 33 and outer rim plate 26. The height d1 of the lower shoe 32 ranges from 20 to 30 inches. The height d2 of the upper shoe ranges from 12 to 18 inches. The only lost storage height h10 is the height of the floating roof with its outer rim seal 26. This represents a storage savings over the prior art of FIG. 1 of about 24 inches.

Figure 3:
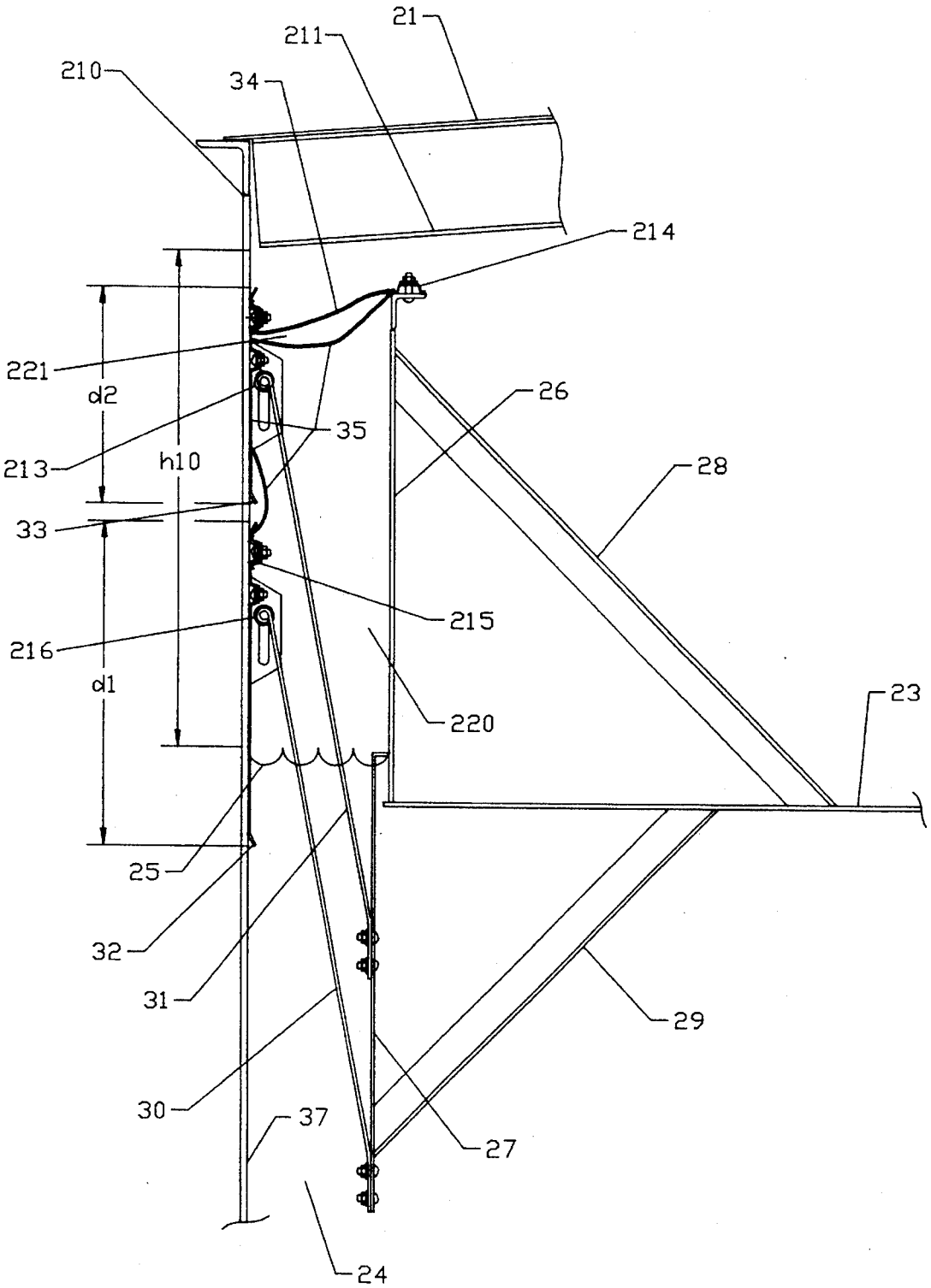
FIG. 3 is a cross sectional view of the space saving double seal applied to a pan type floating roof.

Referring next to FIG. 3 the invention of FIG. 2 is seen in better detail. The topmost level of the liquid bearing surface of the tank is shown at 210. The floating roof 23 with outer rim plate 26 cannot rise above level 210 because the top of outer rim plate 26 would abut roof support members 211.

Therefore, the height h10 is always lost as liquid storage space regardless of the sealing arrangement. The present invention provides a double seal arrangement without affecting the lost storage space height h10.

The primary vapor barrier 35 is attached to the top of the outer rim plate 26 by means of bolts 214. It then passes behind pusher spring mount 213 and is attached to the top of lower shoe 32 by means of bolts 215. Pusher spring 30 is attached to lower shoe 32 by means of pusher spring mount 216. The primary vapor space 220 becomes vapor saturated. The secondary vapor space 221 captures any leaks from the primary vapor space 220. The floating roof 23 supports an optional upper brace 28.

Figure 4:
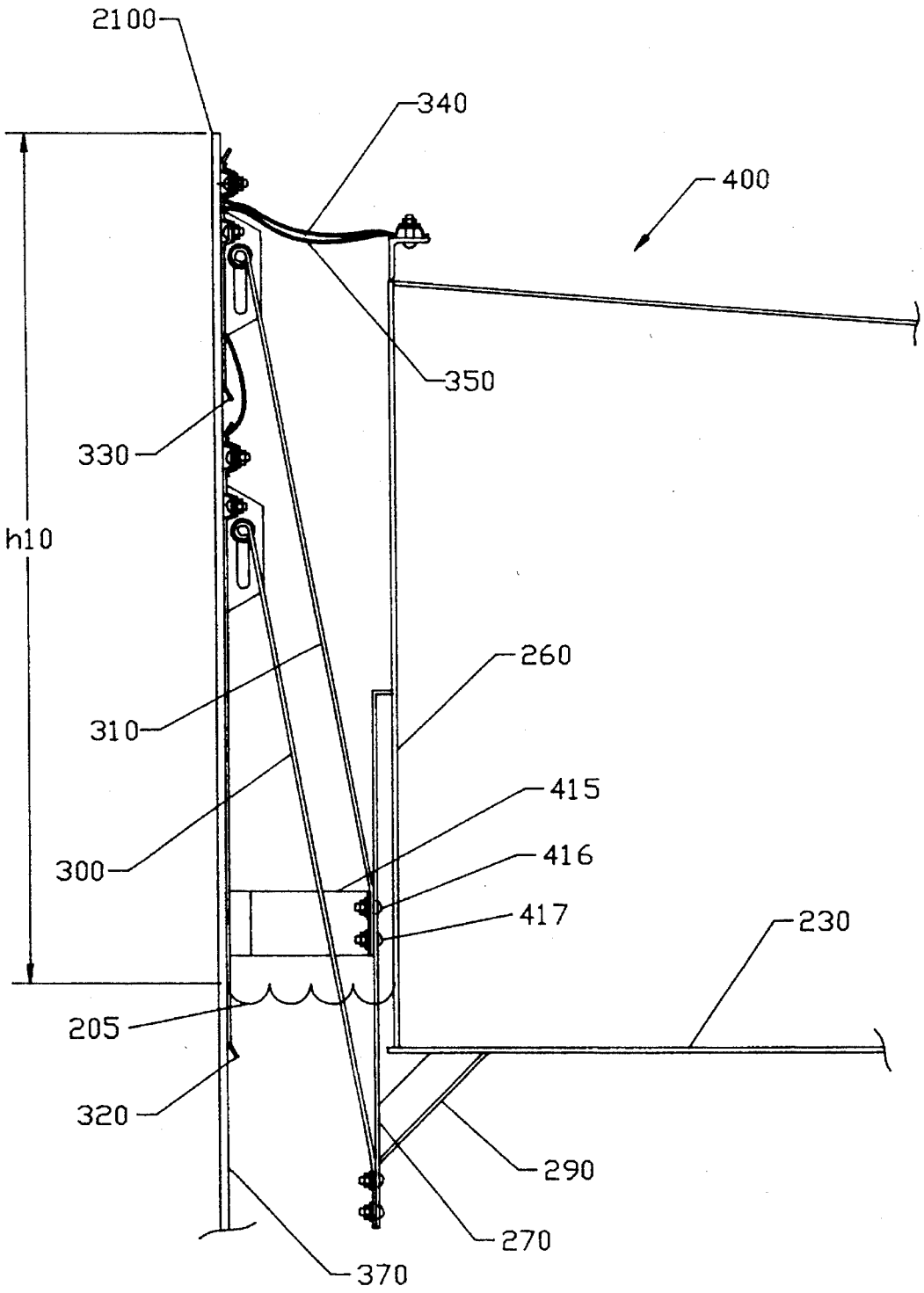
FIG. 4 is a cross sectional view of the space saving double seal applied to a pontoon type floating roof.

Referring next to FIG. 4 a pontoon type floating roof 400 is shown. Substantially all other details of the invention are the same as shown in FIG. 3. An open top external floating roof type tank 201 is shown. The top surface of the liquid is numbered 205. Height h10 is the same. An outer rim plate 260 supports a pusher brace 270. It should be noted that pusher brace 270 or pusher brace 27 of FIG. 3 could alternatively be supported directly off the bottom 230 of the floating roof 400 or 23 of FIG. 3. A brace 290 supports the spring pressure of pusher spring 300. Pusher spring 300 pushes lower shoe 320 against inner wall 370. Pusher spring 310 pushes upper shoe 330 against inner wall 370. Level 2100 is the uppermost limit of travel of the outer rim plate 260.

Primary and secondary vapor barriers 350, 340 are equivalent to 35, 34 of FIG. 3. An optional horizontal spring 415 is attached to the pusher brace 270 by means of bolts 416, 417. Horizontal spring 415 helps hold the lower portion of lower shoe 320 against the inner wall 370.

Figure 5:
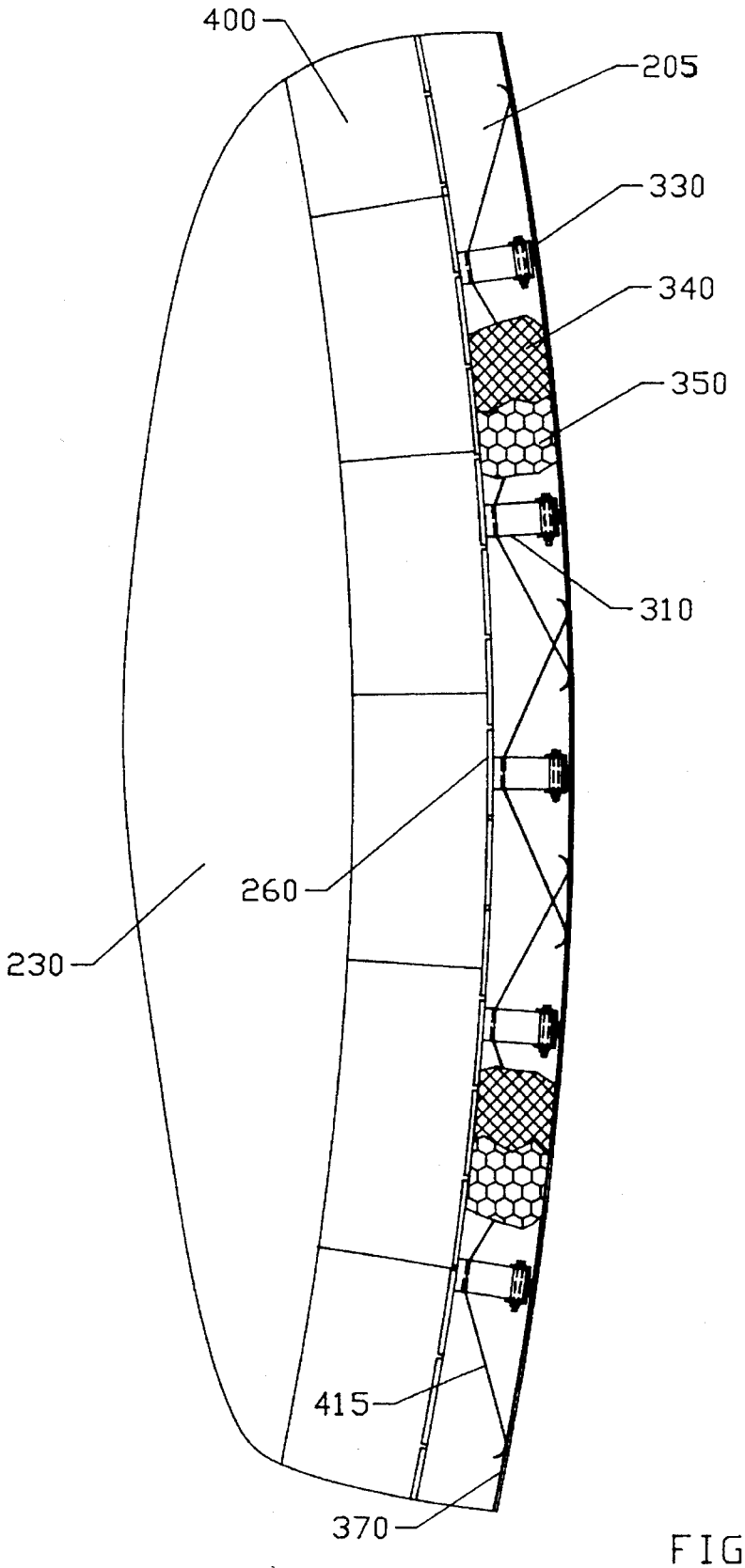
FIG. 5 is a top plan view of a single section of the space saving double seal shown in FIG. 4.

Referring next to FIG. 5 the pontoon type floating roof 400 of FIG. 4 is shown in a top plan view. There is a partial cutaway of the primary and secondary vapor barriers 350, 340.

Figure 6:
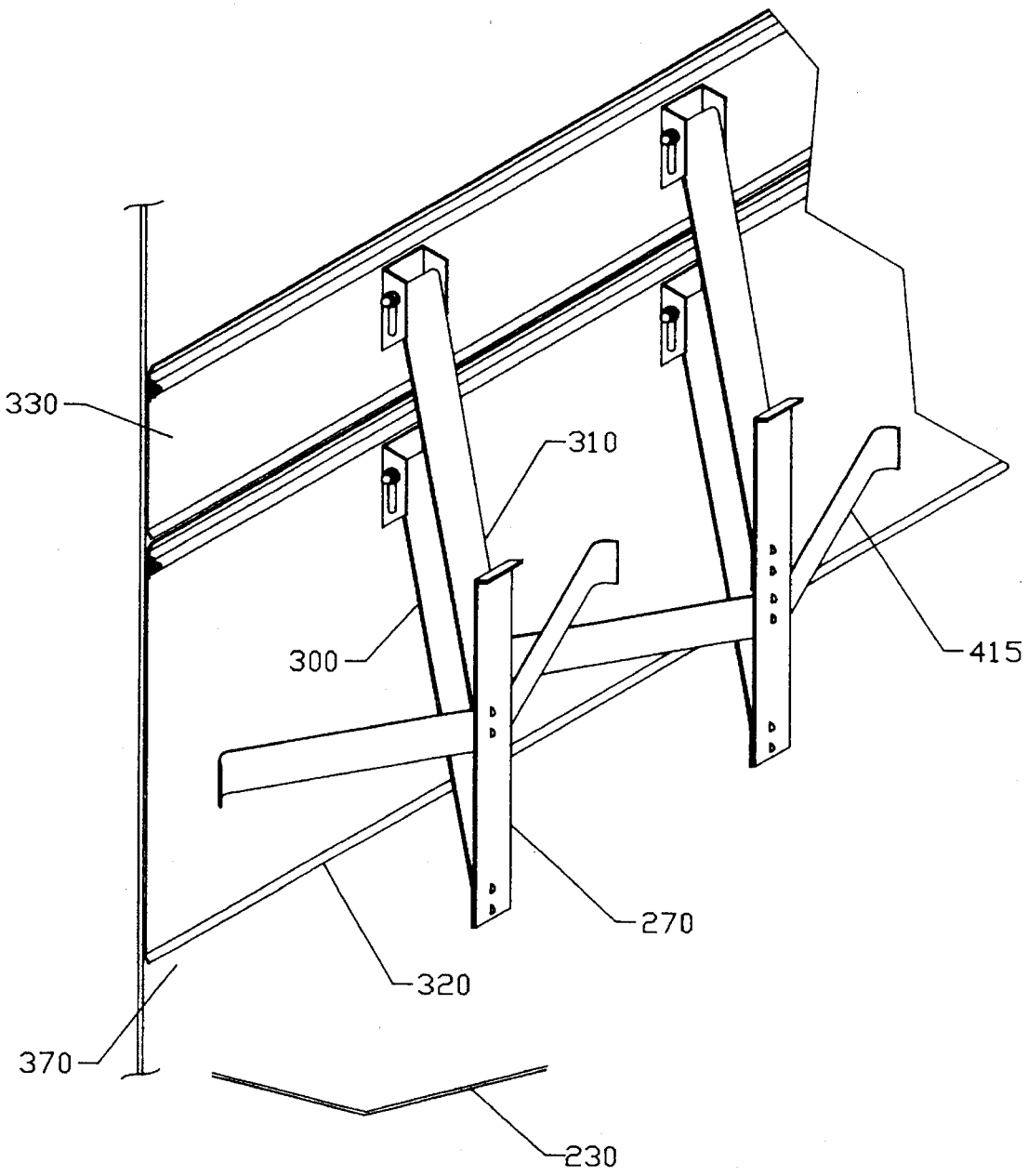
FIG. 6 is a top perspective view of the inside of the tank having the space saving double seal of FIG. 5.

Referring last to FIG. 6 the view shows a cutaway of the outer rim plate 260 of FIG. 4. The pusher brace 270 and all the metal members of the invention are shown. The vapor barriers 340, 350 have been deleted.

It should be noted that the present invention is totally applicable to open top as well as closed roof tanks.

Figure 7:
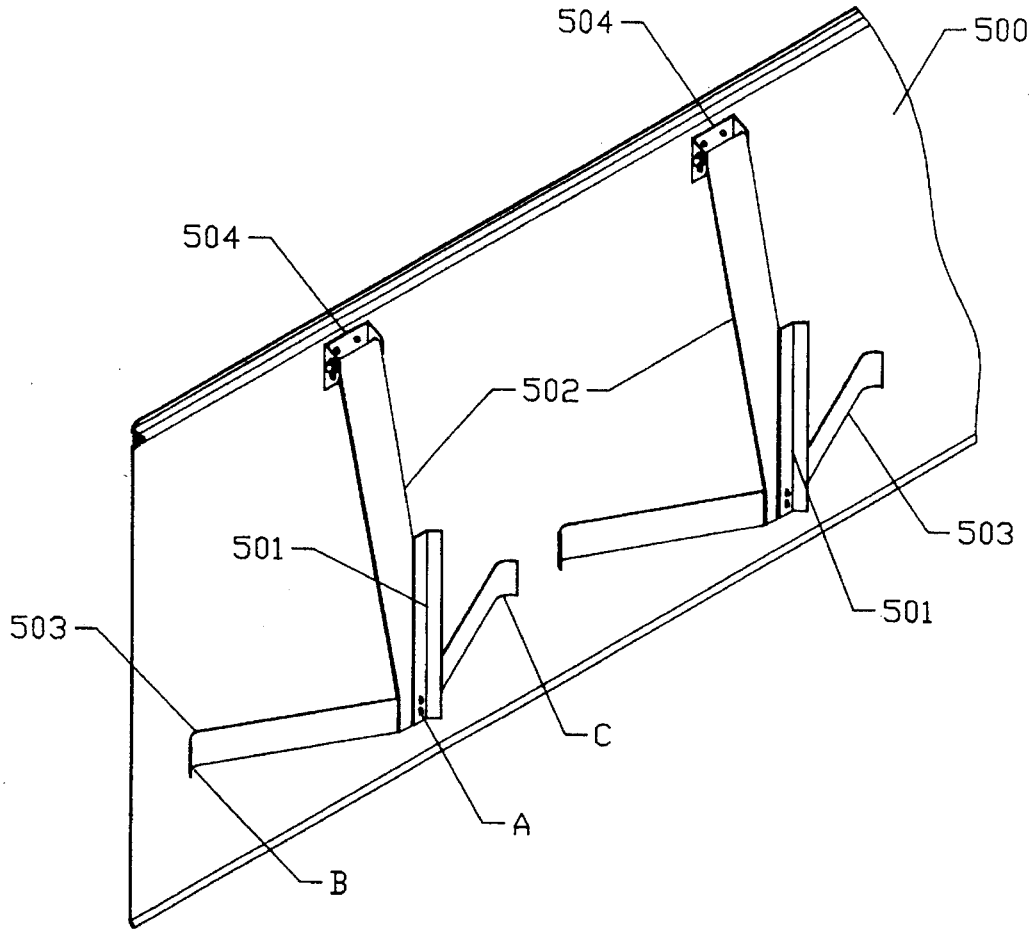
FIG. 7 is a top perspective view of a single horizontal leaf spring and pusher brace combination on a primary shoe.
Figure 8:
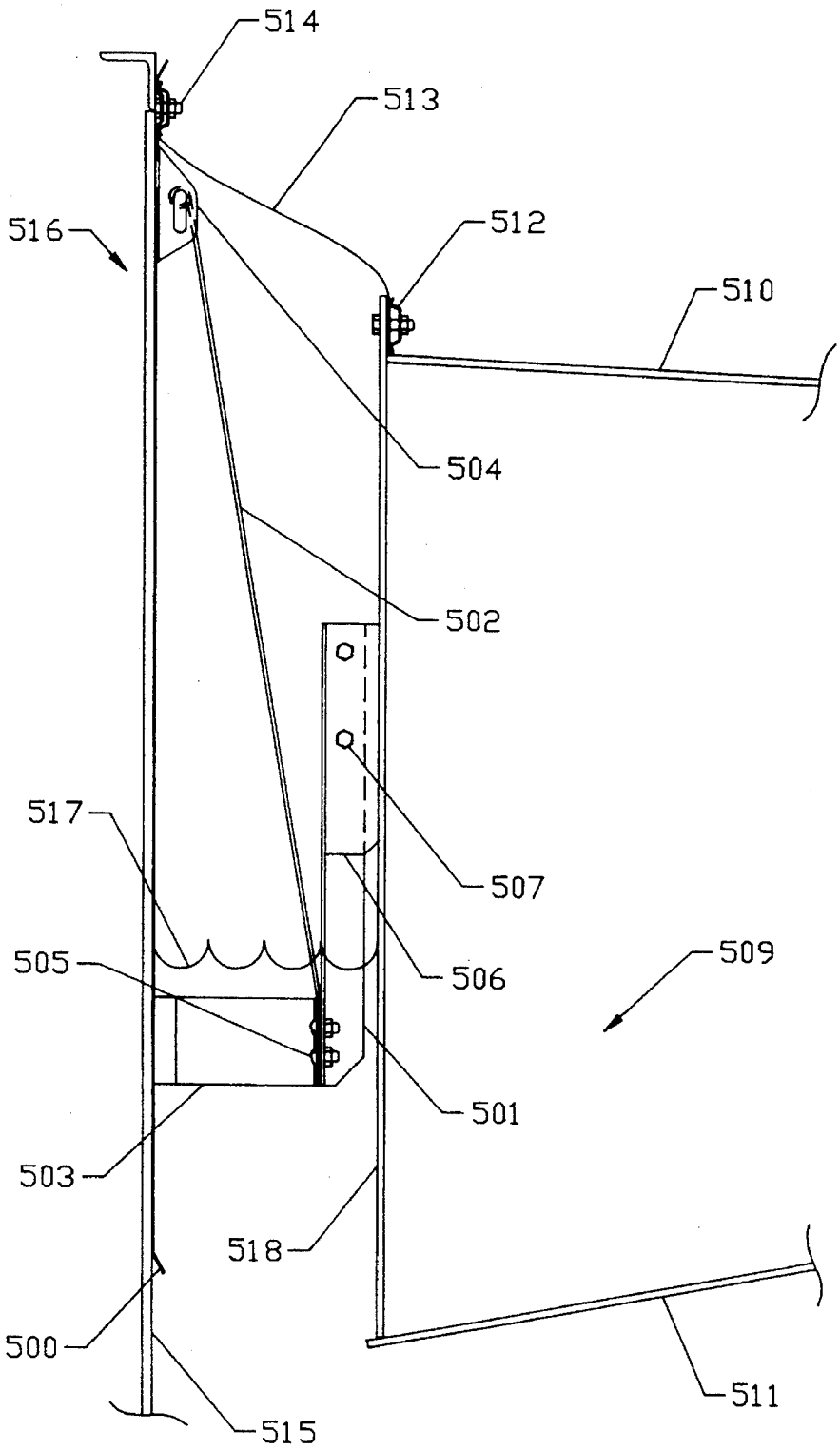
FIG. 8 is a cross sectional view of a tank having an external floating roof and the primary shoe assembly of FIG. 7.

Referring next to FIGS. 7,8 a storage tank 516 has an inner wall 515 and a fluid level 517. The external floating roof 509 has a lower member 511 and an upper member 510. The outer rim plate 518 joins members 510, 511. A pusher brace 501 is a flexible shaft which depends downward from the outer rim plate 518. A rim attachment lug 506 is welded to the outer rim plate 518 and bolts 507 secure the pusher brace 501 to the rim attachment lug 506.

A primary shoe 500 is held against the inner wall 515 by means of the vertical pusher spring 502 and pusher brace 501 assembly and the horizontal leaf spring 503. The horizontal leaf spring 503 has a V shape. It is attached to the pusher brace 501 with bolts 505 at point A. It pushes on shoe 500 at points B, C. A hanger bracket 504 attaches the vertical pusher spring 502 which can be seen as angled toward primary shoe 500 to the shoe 500. A primary vapor barrier 513 is mounted to the top of the shoe 500 by hold down channel 514 and the top of the outer rim plate 518 by hold down channel 512. The combination of the spring forces of the 501, 502 assembly and the 501, 503 assembly provides forces evenly along the shoe 500 at the short intervals between B, 504 and C. This even distribution of spring forces provides an excellent seal between the inner wall 515 and shoe 500.

Figure 9:
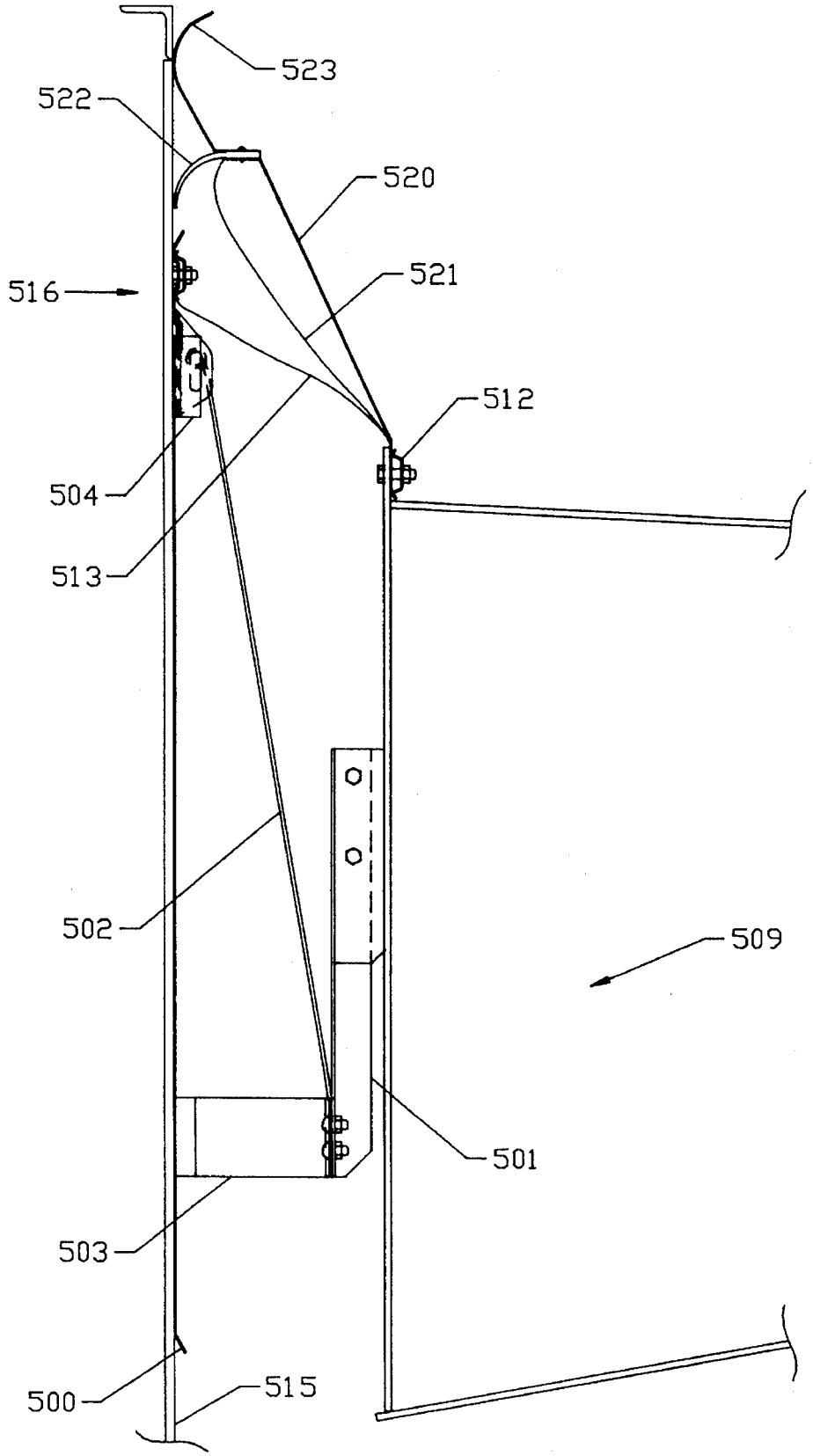
FIG. 9 is the cross sectional view of FIG. 8 with the addition of a traditional wiper type secondary vapor barrier above the primary shoe.

Referring next to FIG. 9 the identical roof and shoe assembly of FIGS. 7, 8 is shown with the addition of a traditional secondary vapor barrier 521 which is fastened along with the primary vapor barrier 513, and a compression plate 520 by the hold down channel 512. The compression plate 520 supports a wiper 522 and a weather shield 523.

Figure 10:
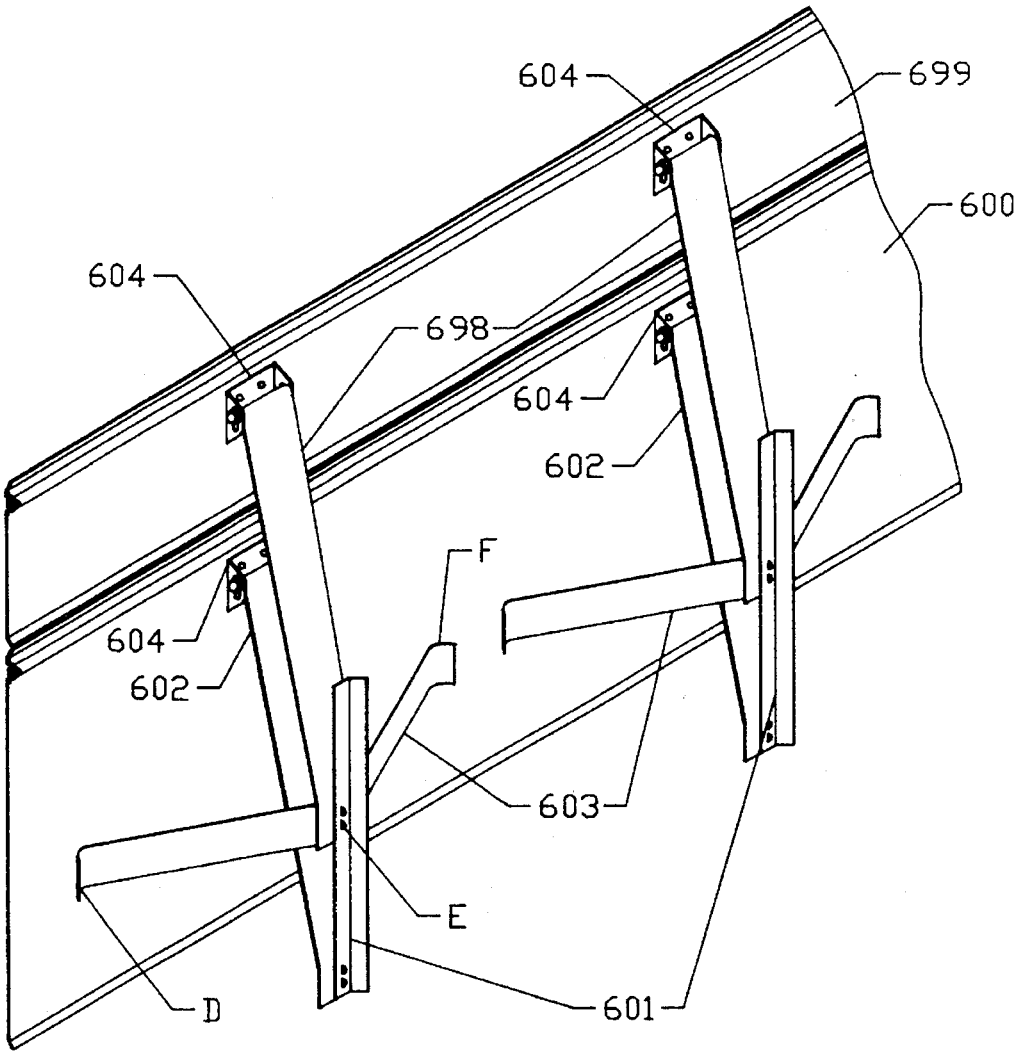
FIG. 10 is a top perspective view of a double shoe embodiment of the leaf spring combination of FIG. 7.
Figure 11:
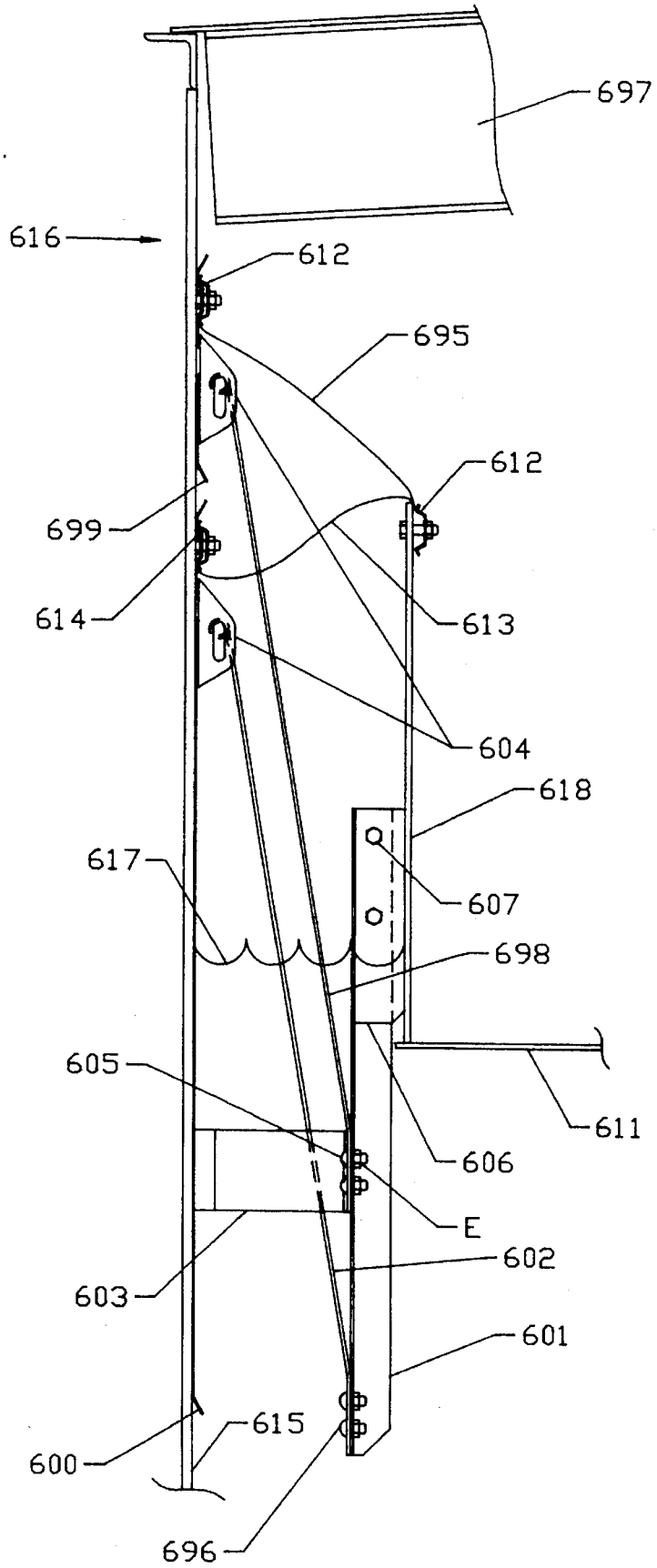
FIG. 11 is a cross sectional view of a tank having an internal floating roof with the double shoe sealing arrangement of FIG. 10.

Referring next to FIGS. 10, 11 a double shoe embodiment is shown. The primary shoe 600 is supported by the combination of the pusher brace 601, vertical pusher spring 602, and the horizontal leaf spring 603. The leaf spring 603 pushes on the primary shoe 600 at points D, F. It is affixed to the pusher brace 601 at point E. The secondary shoe pusher spring 698 is also affixed to the pusher brace 601 at point E. The top of secondary shoe pusher spring 698 exerts force on the top of the secondary shoe 699 via its support, the hanger bracket 604. A vertical pusher spring 602 exerts force on the top of the primary shoe 600 via its support, the hanger bracket 604.

In FIG. 11 the tank 616 can be seen having an inner wall 615 and a roof 697. The fluid level is designated 617.

A hanger bracket 614 fastens the primary vapor barrier 613 to the top of primary shoe 600. Bolts 605 fasten the leaf spring 603 and the secondary shoe pusher spring 698 to the pusher brace 601 at point 3. Bolts 696 fasten the vertical pusher spring 602 to the pusher brace 601. Bolts 607 fasten the pusher brace 601 to the rim attachment lug 606. The rim attachment lug 606 is welded to the outer rim plate 618 which extends upward from the periphery of the internal floating roof 611.

Hold down channels 612 secure the secondary vapor barrier 695 between the outer rim plate 618 and the top of the secondary shoe 699.

Figure 12:
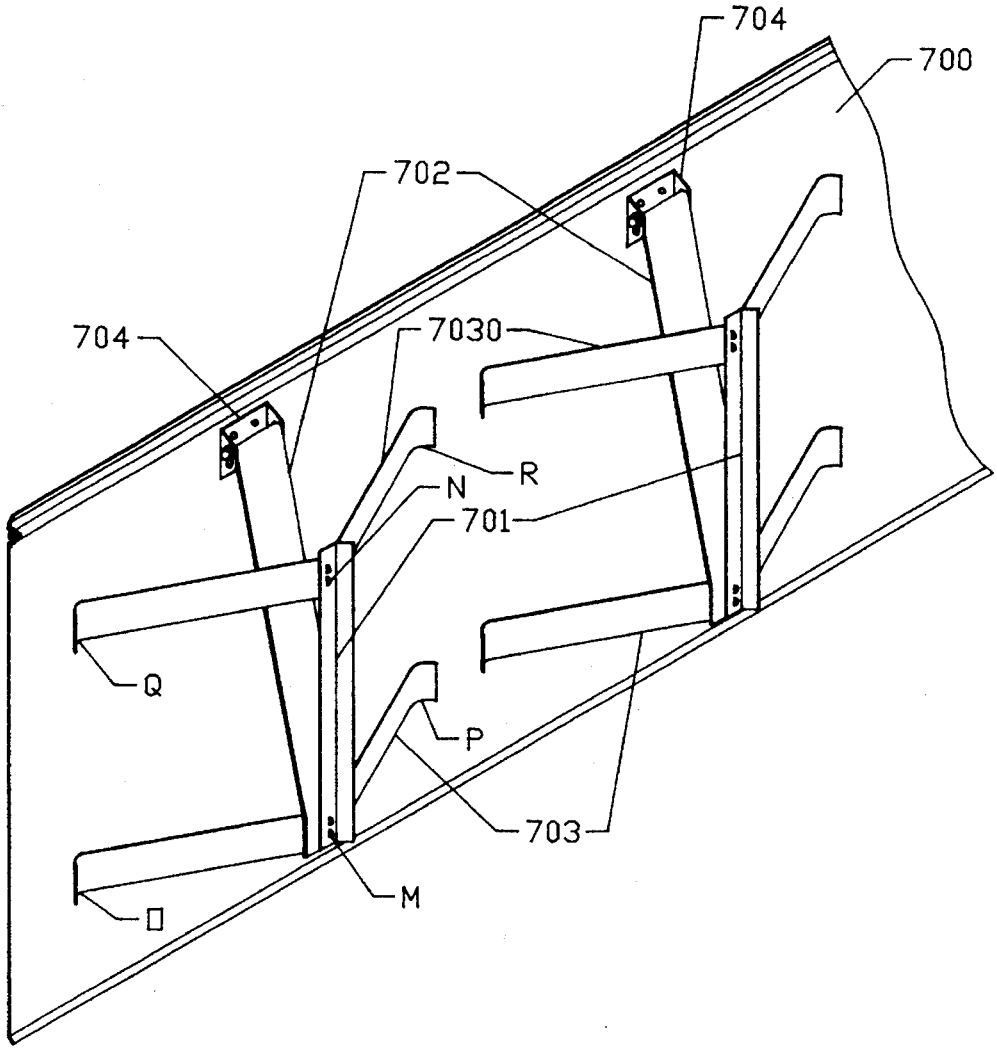
FIG. 12 is a top perspective view of a primary shoe having a double leaf spring and pusher brace combination.
Figure 13:
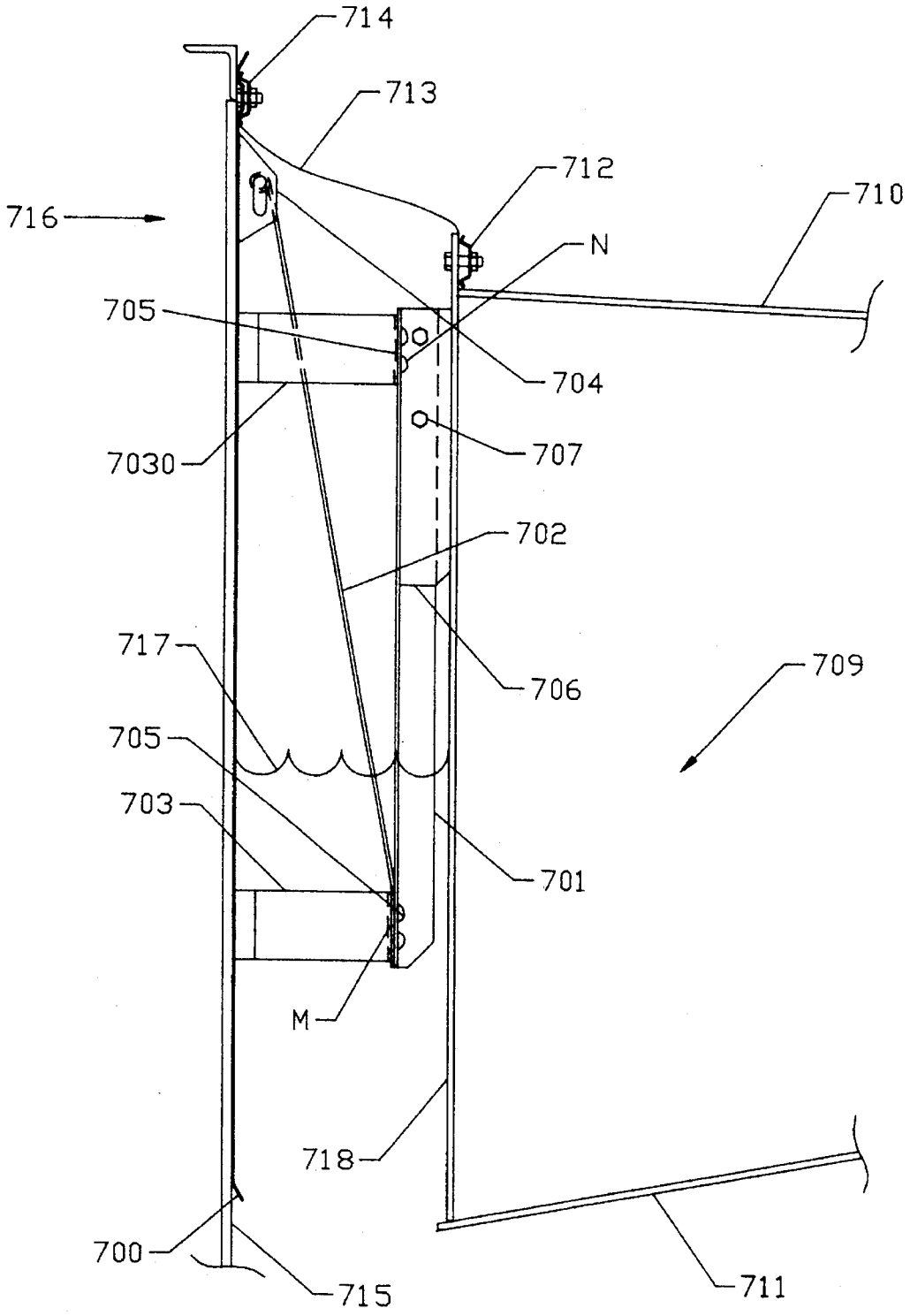
FIG. 13 is a cross sectional view of a tank having an external floating roof and the primary shoe of FIG. 12.

Referring next to FIGS. 12, 13 a storage tank 716 has an inner wall 715 and a fluid level 717. The external floating roof 709 has a lower member 711 and an upper member 710. The outer rim plate 718 joins members 710, 711. A pusher brace 701 depends downward from the outer rim plate 718. A rim attachment lug 706 is welded to the outer rim plate 718 and bolts 707 secure the pusher brace 701 to the rim attachment lug 706.

A primary shoe 700 is held against the inner wall 715 by means of the vertical pusher spring 702 and pusher brace 701 assembly and the horizontal leaf spring 703. The horizontal leaf spring 703 has a V shape. A like horizontal leaf spring 7030 also has a V shape. They are attached to the pusher brace 701 with bolts 705 at points M, N. They push on shoe 700 at points 0, P, Q, R. A hanger bracket 704 attaches the vertical pusher spring 702 to the shoe 700. A primary vapor barrier 713 is mounted to the top of the shoe 700 by hold down channel 714 and the top of the outer rim plate 718 by hold down channel 712. The combination of the spring forces of the 701, 702 assembly and the 701, 703, 7030 assembly provides forces evenly along the shoe 700 at the short intervals between Q, N, R, 704 and 0, M, P. This even distribution of spring forces provides an excellent seal between the inner wall 715 and shoe 700.

Figure 14:
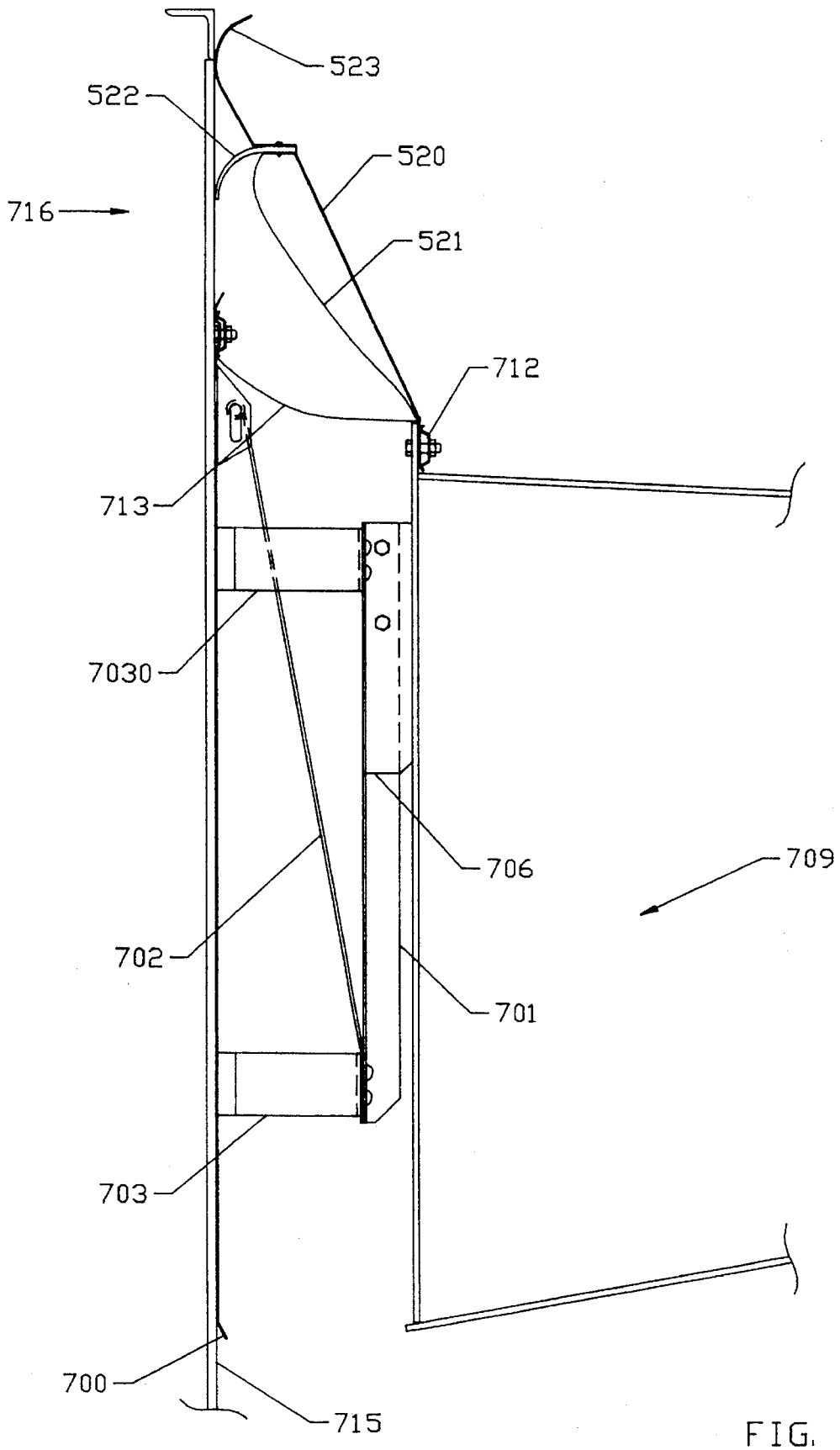
FIG. 14 is a cross sectional view of the primary shoe seal of FIG. 13 with the addition of a traditional wiper type secondary vapor barrier.

Referring next to FIG. 14 the identical roof and shoe assembly of FIGS. 12, 13 is shown with the addition of a traditional secondary vapor barrier 521 which is fastened along with the primary vapor barrier 713, and a compression plate 520 by the hold down channel 712. The compression plate 520 supports a wiper 522 and a weather shield 523.

Figure 15:
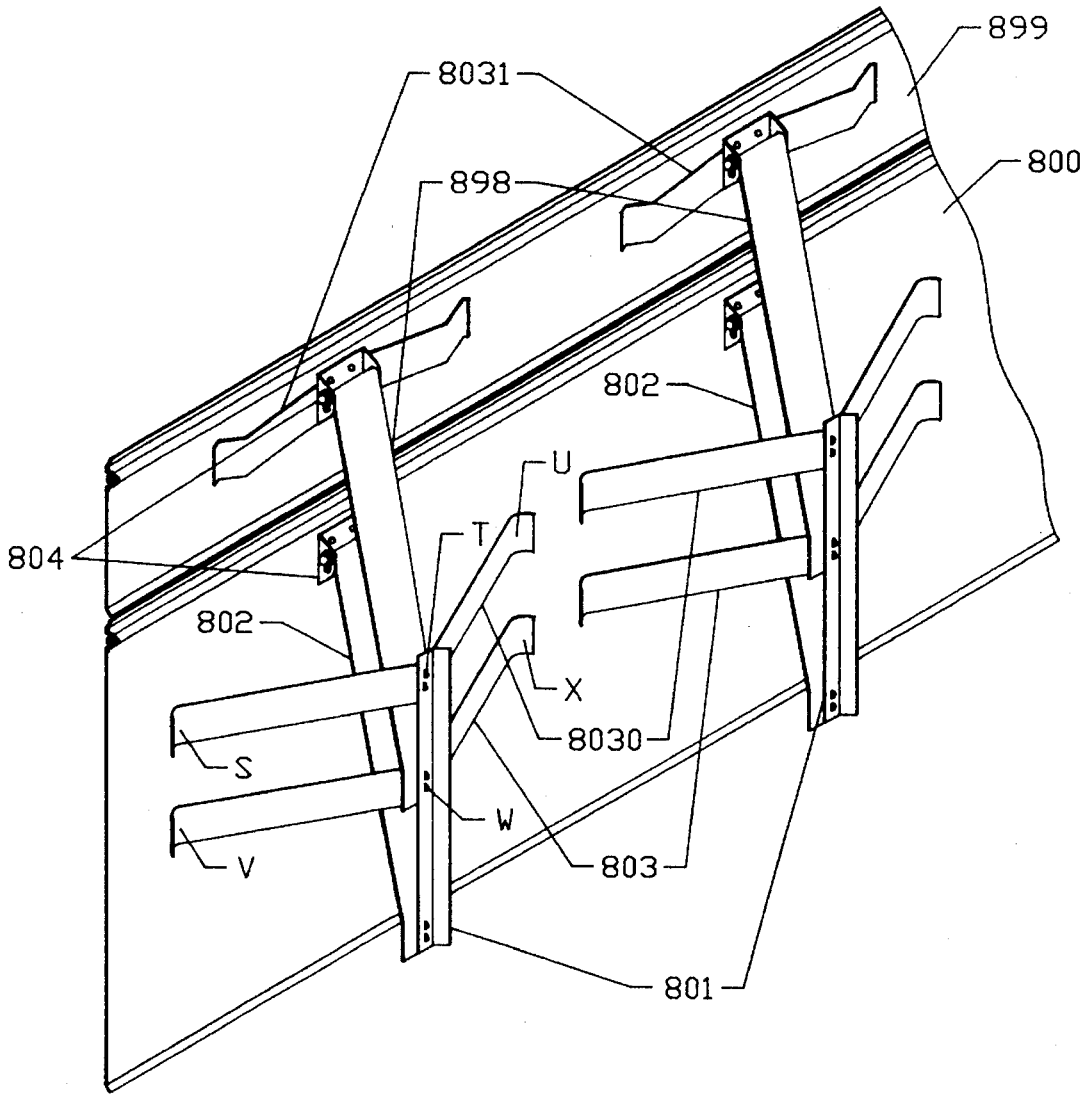
FIG. 15 is a top perspective view of a double leaf spring and pusher brace combination on a primary shoe and a secondary shoe with a leaf spring.
Figure 16:
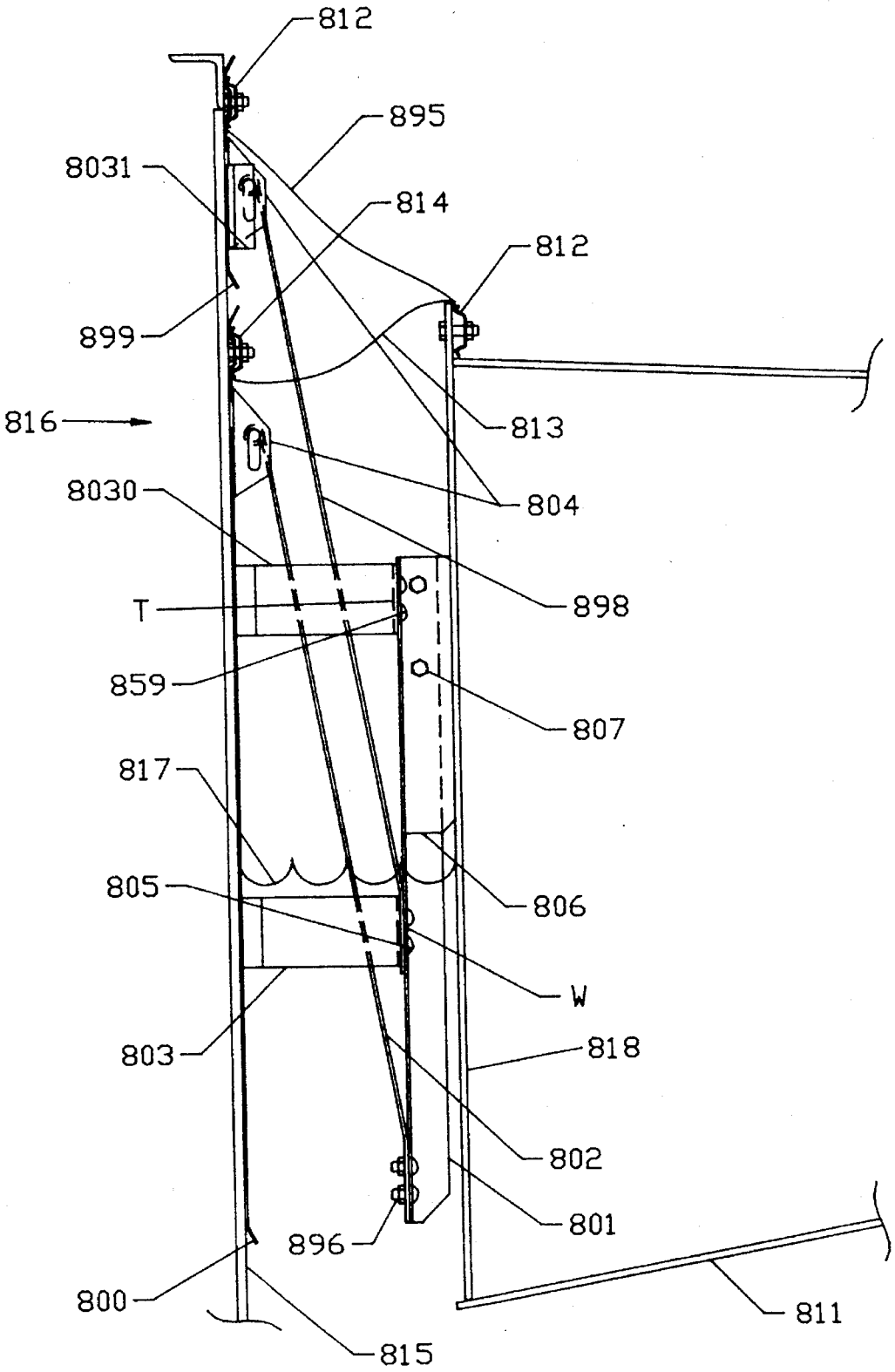
FIG. 16 is a cross sectional view of a tank having an external floating roof with the double shoe sealing arrangement of FIG. 15.

Referring next to FIGS. 15, 16 a double shoe embodiment is shown. The primary shoe 800 is supported by the combination of the pusher brace 801, vertical pusher spring 802, and the horizontal leaf springs 803, 8030. The leaf springs 803, 8030 push on the primary shoe 800 at points S, U, V, and X. They are affixed to the pusher brace 801 at points T, W. The secondary shoe pusher spring 898 is also affixed to the pusher brace 801 at point W. The top of secondary shoe pusher spring 898 exerts force on the top of the secondary shoe 899 via its support, the hanger bracket 804. A vertical pusher spring 802 exerts force on the top of the primary shoe 800 via its support, the hanger bracket 804.

The tank 816 can be seen having an inner wall 815. The fluid level is designated 817.

A hanger bracket 814 fastens the primary vapor barrier 813 to the top of primary shoe 800. Bolts 805 fasten the leaf spring 803 and the secondary shoe pusher spring 898 to the pusher brace 801 at point W. Bolts 896 fasten the vertical pusher spring 802 to the pusher brace 801. Bolts 807 fasten the pusher brace 801 to the rim attachment lug 806. The rim attachment lug 806 is welded to the outer rim plate 818 which extends upward from the periphery of the external floating roof 811. Bolts 859 fasten the leaf spring 8030 to the pusher brace 801 at point t.

Hold down channels 812 secure the secondary vapor barrier 895 between the outer rim plate 818 and the top of the secondary shoe 899. A leaf spring 8030 is secured to the top of the secondary leaf spring 898 to add yet a further sealing force between the secondary shoe 899 and the inner wall 815.

Although the present invention has been described with reference to preferred embodiments, numerous modifications and variations can be made and still the result will come within the scope of the invention. No limitation with respect to the specific embodiments disclosed herein is intended or should be inferred.

I claim:

1. In a liquid storage tank having an inner wall and a floating roof having an outer periphery, and an outer rim plate extending upwards therefrom, a shoe assembly comprising a plurality of shoes spaced circumferentially about said inner wall and each having:

at least three pusher braces comprising a attachment means to the outer rim plate and a flexible shaft depending downward from the attachment means;

at least three horizontal leaf springs each having leaf arms springingly engaged with the shoe, the number of horizontal leaf springs corresponding to the number of pusher braces, each horizontal leaf spring comprising attachment means to the corresponding pusher brace; and at least three vertical pusher springs, the number of pusher springs corresponding to the number of pusher braces, each having attachment means to the corresponding pusher brace and attachment means to the shoe thereby providing at least nine horizontal forces and at least three vertical forces on the shoe.

2. The shoe of claim 1 wherein said pusher brace attachment means to the outer rim plate further comprises a rim attachment lug and bolts.

3. The shoe of claim 1 wherein said leaf spring attachment means to the pusher brace further comprises bolts.

4. The shoe of claim 1 wherein said vertical pusher spring attachment means to the pusher brace further comprises bolts and the attachment means to the shoe further comprises a hanger bracket.

5. The shoe of claim 1 further comprising a primary vapor barrier between the outer rim plate and the shoe and a secondary vapor barrier means.

6. The shoe of claim 5 wherein said secondary vapor barrier means further comprises a second shoe having a flexible seal between said second shoe and the outer rim plate.

7. The shoe of claim 5 wherein said secondary vapor barrier means further comprises a compression plate extending upwardly from the outer rim plate, and said compression plate having a wiper engaged with the inner wall and a flexible secondary vapor barrier.

8. In a liquid storage tank having a inner wall and a floating roof having an outer periphery and an outer rim plate extending upwards therefrom, a shoe assembly comprising a plurality of shoes spaced circumferentially about said inner wall and each having:

at least three pusher braces comprising an attachment means to the outer rim plate and a flexible shaft depending downward from the attachment means;

a pair of horizontal leaf springs, the number of pairs of horizontal leaf springs corresponding to the number of pusher braces, each pair comprising attachment means to the pusher brace and each having leaf arms springingly engaged with the shoe; and at least three vertical pusher springs, the number of pusher springs corresponding to the number of pusher braces, each vertical pusher spring having attachment means to the corresponding pusher brace and attachment means to the shoe, thereby providing at least fifteen horizontal forces and at least three vertical forces on the shoe.

9. The shoe of claim 8 wherein said pusher brace attachment means to the outer rim plate further comprises a rim attachment lug and bolts.

10. The shoe of claim 8 wherein said leaf spring attachment means to the pusher brace further comprises bolts.

11. The shoe of claim 8 further comprising a primary vapor barrier between the outer rim plate and the shoe and a secondary vapor barrier means.

12. The shoe of claim 11 wherein said secondary vapor barrier means further comprises a second shoe having a flexible seal between said second shoe and the outer rim plate.

13. The shoe of claim 12 wherein said second shoe further comprises a vertical pusher spring attached to the pusher brace and a leaf spring attached to the top of the vertical pusher spring.

14. The shoe of claim 11 wherein said secondary vapor barrier means further comprises a compression plate extending upwardly from the outer rim plate, and said compression plate having a wiper engaged with the inner wall and a flexible secondary vapor barrier.

* * * * *